United States Patent [19]

Kelly

[11] 4,279,189

[45] Jul. 21, 1981

[54] BASS DRUM SPUR AND STABILIZER ASSEMBLY

[75] Inventor: Lawrence J. Kelly, Covington, Ky.

[73] Assignee: Baldwin Piano & Organ Company, Cincinnati, Ohio

[21] Appl. No.: 125,937

[22] Filed: Feb. 29, 1980

[51] Int. Cl.[3] ..... G10D 13/02

[52] U.S. Cl. ..... 84/421

[58] Field of Search ..... 84/411 R, 421; 248/443

[56] References Cited

U.S. PATENT DOCUMENTS

| | | | |
|---|---|---|---|
| 2,503,135 | 4/1950 | Sikora | 84/421 |
| 2,919,618 | 1/1960 | Slingerland | 84/421 |
| 3,535,976 | 10/1970 | Osuga | 84/421 |
| 3,541,914 | 11/1970 | Thompson | 84/421 |
| 3,561,716 | 2/1971 | Thompson | 84/421 |

*Primary Examiner*—L. T. Hix
*Assistant Examiner*—Alan Mathews
*Attorney, Agent, or Firm*—Frost & Jacobs

[57] ABSTRACT

A spur and stabilizer assembly for a bass drum. The assembly comprises a pair of tubular stabilizer elements with their upper ends mounted substantially adjacent each other to the inside surface of the bass drum shell. The tubular stabilizer elements extend downwardly, laterally and forwardly with respect to and within the bass drum shell. A pair of spur brackets are affixed to the outside of the shell and have portions extending through perforations in the shell. The lower end of each of the tubular stabilizer elements is operatively and adjustably connected to the adjacent one of the spur brackets. A pair of spurs is provided. Each of the spur brackets has a bore therethrough, coaxial with its respective tubular stabilizer element. Each spur is telescopically received in one of the spur bracket bores and the connected one of the tubular stabilizing elements. A set screw is mounted in each spur bracket to retain the spur therein in adjusted axial position.

7 Claims, 8 Drawing Figures

BASS DRUM SPUR AND STABILIZER ASSEMBLY

TECHNICAL FIELD

The invention relates to the spur and stabilizer of a bass drum, and more particularly to an assembly intregrating the spurs and stabilizer.

BACKGROUND ART

In the conventional arrangement, a bass drum is supported by the base of the pedal assembly for the drum and a pair of feet, normally referred to as "spurs". The spurs are individually and separately mounted on the lower part of the drum shell. The bass drum is sometimes provided with an internal brace, generally referred to as the "stabilizer". The stabilizer comprises a single rod-like element extending downwardly from the top of the drum shell to the bottom. It is also usual practice to mount on the base drum shell means to support a pair of smaller drums above the shell. These smaller drums are generally referred to as "tom-toms". With this conventional arrangement, vigorous playing transmits forces to the bottom of the shell. These forces tend to flex the shell since the opposing force is supplied by the spurs and these spurs are not rigidly fixed to the stabilizer. As a result, the bass drum has a tendency to "walk". Furthermore, the smaller drums or tom-toms and other accessories mounted on the top of the drum shell move about enough to introduce uncertainty into the strike point locations and the timing intervals of the rhythm.

The present invention is directed to an assembly which integrates the spurs and stabilizer. These elements may be further integrated with the tom-tom holder, if present. The assembly of the present invention rigidifies the bass drum shell against flexing and side-to-side rocking thereby minimizing "walking" of the bass drum and shaking of the tom-toms and other accessories mounted to the bass drum shell.

The structure of the present invention also renders the bass drum shell more rigid. Also the stabilizer is no longer located in the center of the drum shell where a recording microphone would normally be placed. Thus tube noise from the stabilizer is reduced during recording. In the assembly of the present invention the spurs are fully adjustable in an axial direction and the stabilizing elements are also adjustable to accommodate for expansion and contraction of the drum shell.

DISCLOSURE OF THE INVENTION

According to the invention there is provided a spur and stabilizer assembly for a bass drum. The assembly comprises a pair of hollow, tubular stabilizer elements. The upper ends of the stabilizer elements are mounted substantially adjacent each other to the inside surface of the top of the bass drum shell. The tubular stabilizer elements extend downwardly, laterally and forwardly therefrom, within the bass drum shell.

A pair of spur brackets are affixed to the outside of the drum shell. Each of the spur brackets has a portion extending through a perforation in the shell. The lower end of each of the tubular stabilizing elements is operative and adjustably connected to the adjacent one of the spur brackets.

Each of the spur brackets has a bore therethrough coaxial with the tubular stabilizer connected to that spur bracket. A pair of rod-like spurs is provided, each of which is telescopically received in one of the spur bracket bores and the connected one of the stabilizing elements. Each spur bracket has a manually operable set screw by which the spur mounted therein can be locked in adjusted axial position.

When the drum shell is intended to support a pair of tom-toms, an appropriate bracket therefor will be affixed to the outside upper surface of the drum shell. Fastening means for this bracket may also serve as fastening and connecting means for the upper ends of the stabilizing elements.

In one embodiment of the present invention, the lower end of each stabilizer is received with a sliding fit in the bore of the spur bracket. The spur, in turn, is received within the lower end of the stabilizer element. The set screw of the spur bracket clamps the lower end of the stabilizer element in the spur bracket bore and at the same time clamps the lower end of the stabilizer element against the spur to maintain the spur in adjusted axial position.

In another embodiment of the present invention, the lower end of each stabilizer element receives that portion of its respective spur bracket which extends into the drum shell and is clamped thereto. The spur bracket set screw directly clamps the spur within the spur bracket in adjusted axial position.

In yet another embodiment of the present invention the lower end of each stabilizer element receives that portion of its respective spur bracket which extends into the drum shell. The portion of the spur bracket which extends into the drum shell is externally threaded and is provided with a nut adapted to abut the lowermost end of the stabilizer element to maintain it in adjusted position. The set screw of the spur bracket directly contacts and clamps the spur within the spur bracket in adjusted axial position.

BEST MODE OF CARRYING OUT THE INVENTION

Figure 1:
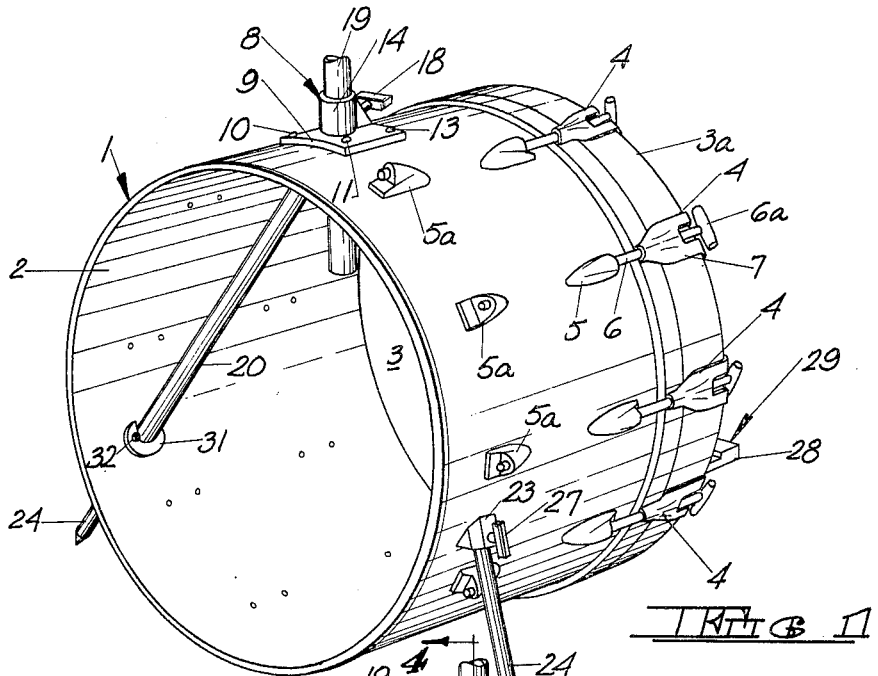
FIG. 1 is a front end and right side perspective view of a bass drum provided with the spur and stabilizer assembly of the present invention.
Figure 2:
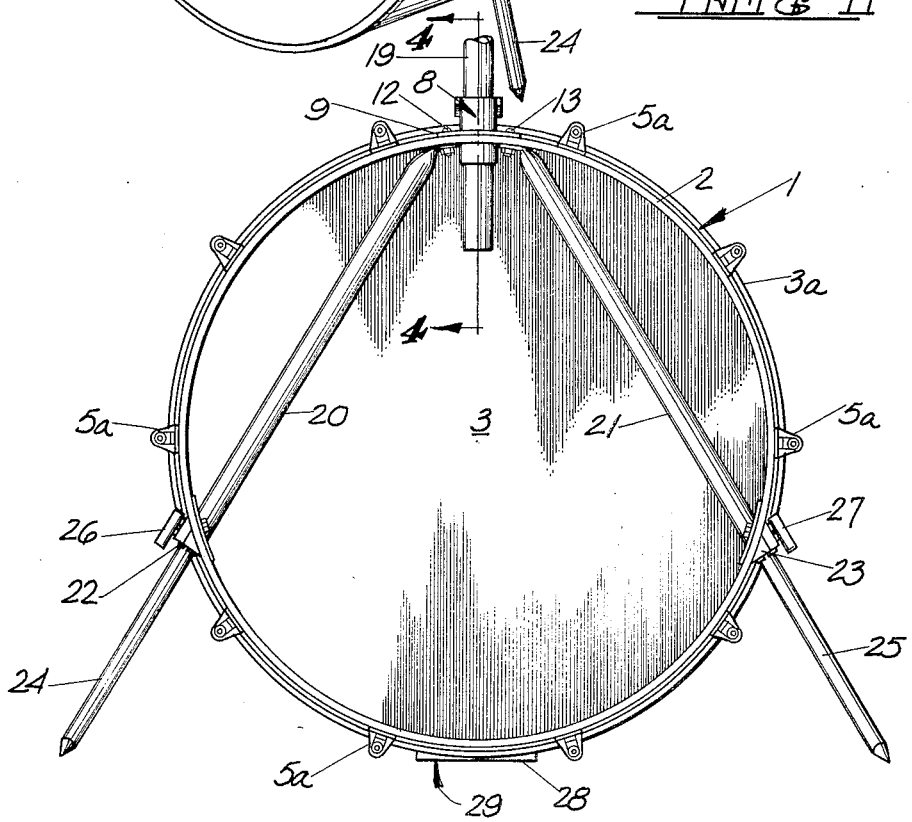
FIG. 2 is a front elevational view of the bass drum of FIG. 1.
Figure 3:
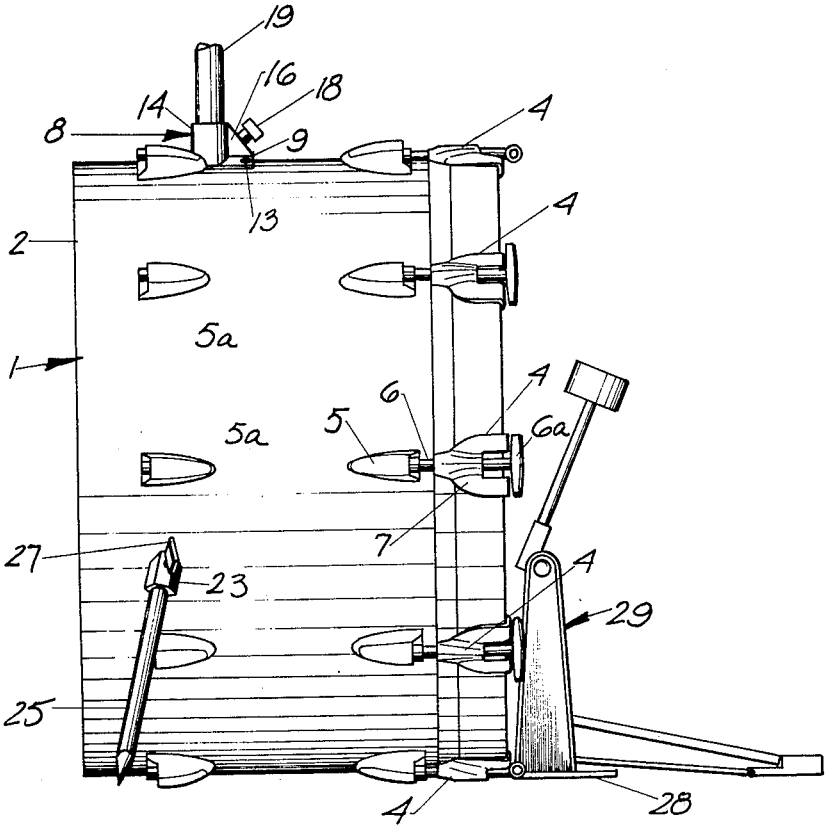
FIG. 3 is a side elevational view of the drum of FIG. 1.

Reference is first made to FIGS. 1, 2 and 3 wherein a conventional bass drum is illustrated, provided with the spur and stabilizer assembly of the present invention. In FIGS. 1, 2 and 3 like parts have been given like index numerals. For purposes of this description, that end of the drum which faces away from the drummer is termed the front end of the drum and the that end of the drum which faces the drummer is termed the rear end of the drum.

The drum is generally indicated at 1 and its cylindrical shell is indicated at 2. The first or rear drum head 3 is shown mounted on the shell 2 by a conventional hood assembly 3*a* and a plurality of identical, conventional clamping means 4. Each clamping means 4 comprises a lug 5 affixed to the shell 2. The lug 5 receives one end of a threaded tension rod 6. The other end of the tension rod 6 terminates in a manually engagable key 6*a*. The tension rod 6 carries a claw hook 7, rotatively mounted thereon. The tension rod 6 carries an annular shoulder (not shown) which engages the claw hook so that when the key 6*a* is turned in one direction the tension rod turns deeper into lug 5 causing claw hook 7 to exert a pulling force on drum head 3 via hook assembly 3*a*. Turning key 6*a* in the opposite direction will loosen the claw hook 7. This can be continued until the claw hook releases hood assembly 3*a* and rear drum head 3 for removal.

For purposes of illustration, the drum 1 is shown with its second or front drum head removed. Lugs for the front drum head are shown at 5*a*. It is common practice to play a bass drum with its front drum head removed.

Figure 4:
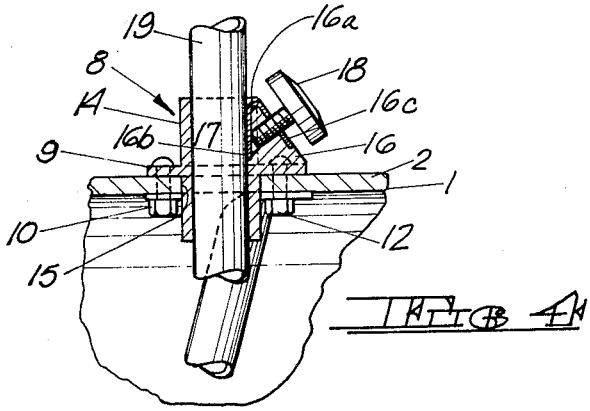
FIG. 4 is a fragmentary cross sectional view taken along section line 4—4 of FIG. 2.

In the embodiment illustrated, the drum 1 is shown provided with a tom-tom holder tube bracket 8. The bracket 8 comprises a plate 9 having a curvature corresponding to the outside surface of shell 2. The plate 9 is affixed to the shell 2 by four bolts 10, 11, 12 and 13 located near the corners of the plate 9. The plate 9 has a central bore in which a hollow cylindrical member 14 is mounted. The cylindrical member 14 extends both above and below the plate 9. That portion of member 14 which extends below the plate 9 passes through a perforation 15 in the drum shell 2. To complete the bracket 8, a triangular member 16 is affixed both to the cylindrical member 14 and the plate 9, as is best shown in FIG. 4. A threaded bore 17 passes through the triangular member 16 and the adjacent part of the cylindrical member 14. The threaded bore 17 is adapted to receive a manually operated set screw 18. An inverted "V"-shaped clip 16*a* is mounted on the triangular member 16. The clip 16*a* has a first let 16*b* depending downwardly in cylindrical member 14 and a second leg 16*c* extending along the front edge of triangular member 16. This second leg 16*c* of clip 16*a* has a perforation therein which is coaxial with threaded bore 17 and through which set screw 18 extends.

A tom-tom holder tube 19 is slidably received in the cylindrical member 14 of bracket 8 and is axially shiftable therein. The tom-tom holder tube 19 is adapted at its upper end to support a tom-tom holder (not shown) which in turn mounts the pair of tom-toms (not shown). The tom-tom holder tube 19 may be shifted axially to locate the tom-toms at a convenient height above bass drum 1 and is locked in adjusted position by set screw 18 which causes leg 16*b* of clip 16*a* to bear against the tom-tom holder tube 19.

The stabilizer of the present invention comprises a pair of tubular elements 20 and 21. The tubular elements 20 and 21 are identical, being open at their bottom ends. As is most clearly shown in FIG. 2, the upper ends of stabilizer elements 20 and 21 are pressed together and bent over for attachment to the drum shell 2. In FIG. 2, a tom-tom bracket bolts 10 and 11 have been omitted to render the tom-tom bracket bolts 12 and 13 visible. The bolts 12 and 13, as is evident in FIG. 2, are also used to attach the upper ends of stabilizer elements 20 and 21 to the inside upper surface of drum shell 2. It will be understood that if a tom-tom bracket 8 is not provided, the upper ends of stabilizer elements 20 and 21 may be bolted directly to the shell 2 by bolts positioned similarly to bolts 12 and 13.

A pair of spur brackets 22 and 23 is mounted on the exterior of drum shell 2. The spur brackets 22 and 23 have portions extending through perforations in the drum shell 2. The lower open ends of stabilizer elements 20 and 21 are affixed to spur brackets 22 and 23, respectively, as will be clearly shown hereinafter. Spur bracket 22 and 23 are each provided with a bore which is coaxial with the hollow interior of its respective one of stabilizer elements 20 and 21. A pair of spurs 24 and 25 are provided. The spur 24 is telescopically received in the bore of spur bracket 22 and the hollow interior of stabilizer element 20. The spur bracket 22 is provided with a manually operated set screw 26 by which spur 24 is held in axially adjusted position. In similar fashion, spur 25 is mounted in the bore of spur bracket 23 and the hollow interior of stabilizer element 21, being maintained in axially adjusted position by a manually operated set screw 27 provided in association with spur bracket 23. It will be evident from FIG. 2 that stabilizer elements 20 and 21 and their respective spurs 24 and 25 slope downwardly and laterally with respect to drum shell 2. It will also be evident from FIGS. 1 and 3 that these same elements slope downwardly and forwardly with respect to drum shell 2. As is shown in FIGS. 2 and 3, the bass drum 1 is supported by spurs 24 and 25 and the base 28 of a conventional bass drum pedal assembly, generally indicated at 29.

Figure 5:
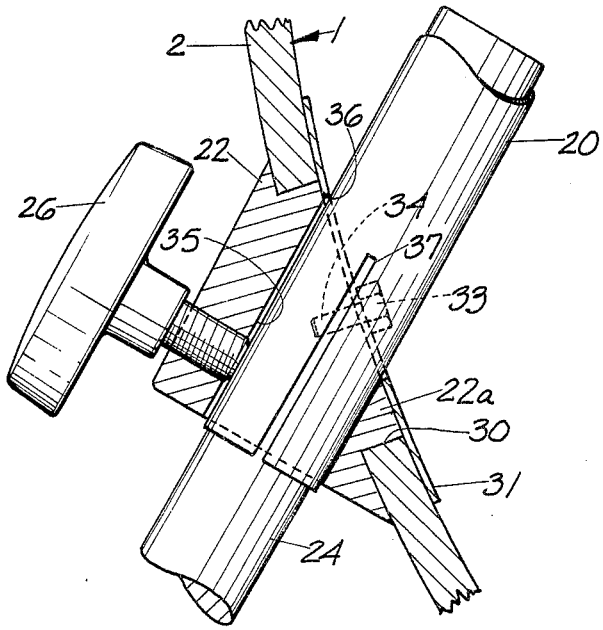
FIG. 5 is a fragmentary cross sectional view of one embodiment of the present invention illustrating a spur bracket, spur and stabilizer element thereof.

Reference is now made to FIG. 5 which is a fragmentary cross sectional view illustrating drum shell 2, stabilizer element 20, spur bracket 22, spur bracket set screw 26 and spur 24.

The spur bracket 22 has a rearward portion 22*a* which extends into a perforation 30 in drum shell 2. A mounting plate 31 is located on the inside surface of drum shell 2 and two machine screws 32 and 33 (see also FIG. 1) extend through perforations in mounting plate 31 and into threaded bores (one of which is shown at 34 in FIG. 5) in spur bracket 22. In this way, spur bracket 22 is affixed to shell 2.

Spur bracket 22 has a bore 35 extending therethrough. It will be noted that mounting plate 31 has a corresponding bore 36. The bore 35 is coaxial with the hollow interior of stabilizer element 20. The lowermost end of stabilizer element 20 is shown in FIG. 5 as extending through the perforation 36 in mounting plate 31 and into bore 35 of spur bracket 22 with clearance. The lowermost end of stabilizer element 20 is bifurcated by a pair of diametrically opposed, axially extending notches, one of which is shown at 37. The spur 24 is telescopically received in stabilizer element 20. The set screw 26 bears against the lowermost end of stabilizer element 20, clamping it in spur bracket perforation 35. Since the lowermost end of stabilizer element 20 is bifurcated, the bifurcations can be squeezed toward each other by set screw 26 with the result that the set screw also serves to clamp spur 24 in position within stabilizer element 20. By means of set screw 26 the axial position of spur 24 within stabilizer element 20 can be adjusted as desired. At the same time, the axial position of stabilizer element 20 can be adjusted with respect to bore 35 of spur bracket 22, thus accommodating for expansion and contraction of drum shell 2. It will be understood that the arrangement of stabilizer element 21, spur bracket 23, spur 25 and set screw 27 will be identical to that shown in FIG. 5.

Figure 6:
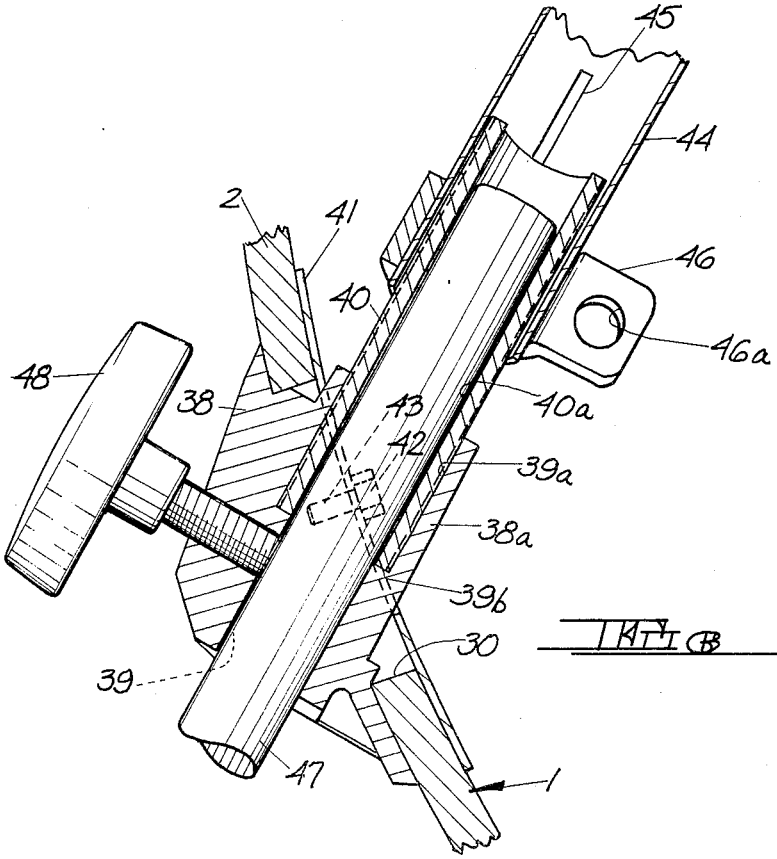
FIG. 6 is a fragmentary cross sectional view of another embodiment of the present invention illustrating a spur bracket, spur and stabilizer element thereof.

FIG. 6 illustrates another embodiment of stabilizer element, spur bracket and spur assembly. FIG. 6 is similar to FIG. 5 and the drum shell is again shown at 2 having a perforation 30 therein. The spur bracket of FIG. 6 is indicated at 38 and has a rearward portion 38*a* extending through drum shell perforation 30. Spur bracket 38 has a bore 39 extending therethrough and equivalent to bore 35 of spur bracket 22 of FIG. 5. The bore 39 has a portion of enlarged diameter 39*a* forming a shoulder 39*b* therebetween. A hollow cylindrical tube-like extension 40 is received within the large diameter bore portion 39*a*. While the engagement of extension 40 with spur bracket 38 may be a threaded engagement, or any other type of engagement, it may be considered for purposes of this description as constituting a press fit. It is within the scope of the invention to have extension 40 constitute an integral one-piece part of spur bracket 38.

The axial bore 40*a* of extension 40 is of the same diameter as spur bracket bore 39 and constitutes a continuation thereof. The spur bracket 38 may be affixed to drum shell 2 in any appropriate manner. For purposes of ths showing, it is illustrated as being provided with a mounting plate 41, similar to mounting plate 31 of FIG. 5. A pair of machine screws (one of which is shown at 42) passes through mounting plate 41 into threaded bores (one of which is shown at 43) in spur bracket 38.

A stabilizer element is illustrated in FIG. 6 at 44 and is equivalent to stabilizer element 20 of FIG. 5. In this instance, the stabilizer element 44 is somewhat shorter and is adapted to receive spur bracket extension 40 with a sliding fit. The lower end of stabilizer element 44 may again be bifurcated by a pair of axially oriented, diametrically opposed notches, one of which is shown at 45. A conventional C-shaped clamp is fragmentarily shown at 46. The ends of the clamp are provided with perforations, one of which is shown at 46*a*, adapted to receive a bolt (not shown). Tightening of clamp 46 will cause engagement of spur bracket extension 40 by stabilizer element 44. This engagement is adjustable, so as to permit compensation for expansion and contraction of drum shell 2.

Spur 47, similar to spur 24 of FIG. 5, is telescopically received in spur bracket bore 39 and spur bracket extension bore 40*a*. If axial adjustment of spur 47 requires it, the upper end of spur 47 can extend into the tubular stabilizer element 44, as will be evident from FIG. 6. Spur 47 is maintained in the desired axial position with respect to spur bracket 38 by set screw 48 similar to set screw 26 of FIG. 5. In this embodiment, set screw 48 directly engages spur 47.

Figure 7:
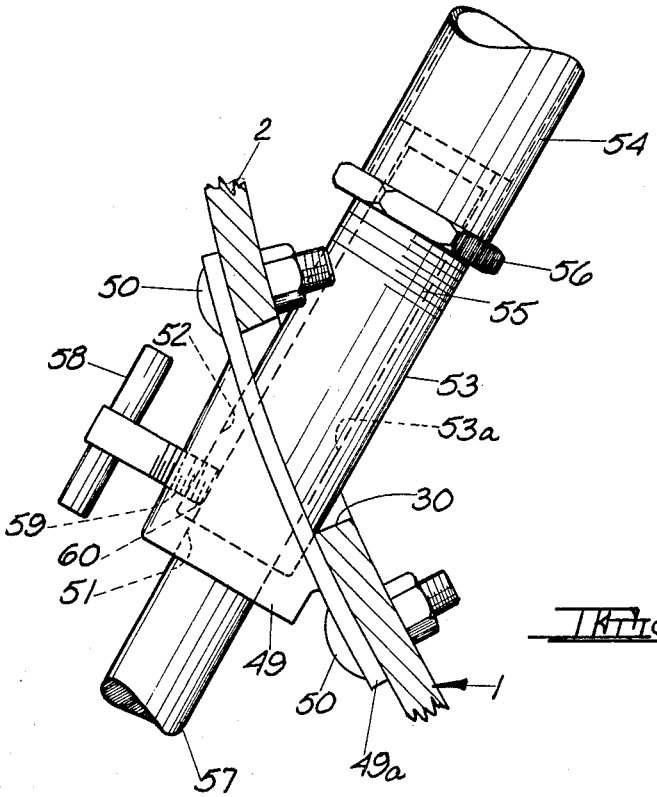
FIG. 7 is a fragmentary cross sectional view, similar to FIGS. 5 and 6, illustrating a spur bracket, spur and stabilizer element of yet another embodiment of the present invention.

Yet another embodiment of stabilizer element, spur bracket and spur assembly is shown in FIG. 7. Again FIG. 7 is similar to FIG. 5 and the drum shell is fragmentarily shown at 2 having a perforation 30 therein. In this embodiment, a spur bracket 49 is shown having an annular flange 49*a* configured to conform to the outside surface of shell 2. The spur bracket 49 is affixed directly to shell 2 by two or more machine screws 50 extending through flange 49*a* and shell 2. The body portion of spur bracket 49 has a first bore 51 leading to a second enlarged bore 52. Received within the bore 52 is a hollow, cylindrical extension 53 similar to extension 40 of the embodiment of FIG. 6. Again, the lower end of extension 53 may be engaged with spur bracket 49 in any suitable manner including a threaded engagement or the like. For purposes of this showing, extension 53 may be considered to have a press fit engagement within spur bracket bore 52. The axial bore 53*a* of extension 53 is of the same diameter as spur bracket bore 51 and constitutes a continuation of spur bracket bore 51. Extension 53 could constitute an integral one-piece part of spur bracket 49.

A tubular stabilizer element is shown at 54. The interior diameter of stabilizer element 54 is such as to just nicely receive the upper end of spur bracket extension 53. The upper end of spur bracket extension 53 is threaded as at 55 and is provided with an adjustment nut 56. The nut 56 is intended to abut the lower end of stabilizer element 54 and maintain it in adjusted position, enabling compensation for expansion and contraction of drum shell 2.

A spur 57, similar to spur 24 of FIG. 5 is slidable axially in spur bracket bore 51, spur bracket extension bore 53*a* and hollow tubular stabilizer element 54. Spur 57 is maintained in axially adjusted position with respect to spur bracket 49 by means of manually operated set screw 58 threadedly engaged in threaded coaxial bores 59 and 60 in spur bracket 49 and extension 53, respectively.

It will be evident from the above description that the structure of the present invention in its various embodiments integrates the drum stabilizer and spurs. The spurs are axially adjustable and the same is true of the stabilizer elements of the present invention, enabling compensation for expansion and contraction of the drum shell. The provision of a pair of stabilizer elements, each integrated with one of the spurs gives direct rigid support from the top of the drum shell to the surface engaged by the spurs. Side-to-side rock of the drum shell is reduced, as is the tendency of the drum to "walk". The drum shell is rigidified by the assembly. Movement of the tom-toms and other accessories mounted to the top of the drum shell is minimized thereby eliminating uncertainty with respect to strike point locations and timing intervals of the rhythm. As is most clearly shown in FIG. 2, the stabilizer of the present invention, made up of two stabilizer elements, is no longer located in the center of the drum shell with the result that there is less mechanical tube noise during recording and recording may be more easily accomplished.

Figure 8:
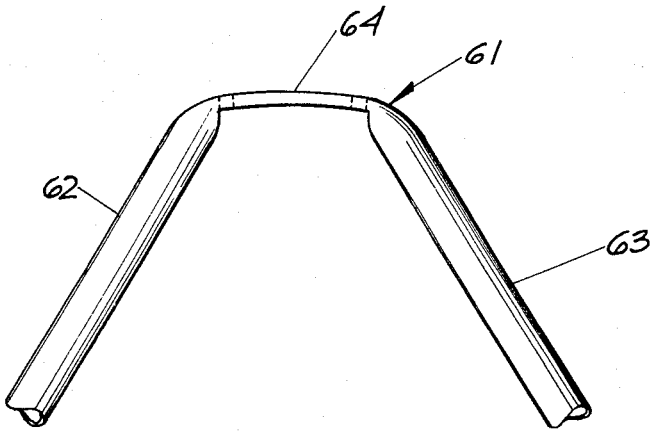
FIG. 8 is a fragmentary elevational view illustrating an integral, one-piece stabilizer element assembly.

Modifications may be made in the invention without departing from the spirit of it. For example, stabilizer elements 20 and 21 have thus far been described as two separate structural members. It would be within the scope of the present invention to make stabilizer elements from a single tubular member flattened in the middle to form the upper ends of the stabilizer elements, the flattened portion being configured to fit the curvature of the shell 2. This is shown in FIG. 8. A single tubular member is generally indicated at 61. Portions 62 and 63 of tubular member 61 constitute stabilizer elements similar to stabilizer elements 20 and 21 of FIG. 2. A flattened central portion 64 of tube 61 constitutes the upper ends of stabilizer elements 62 and 63 and is configured to match the curvature of the drum shell. Thus in the embodiment of FIG. 8 the stabilizer elements 62 and 63 constitute a single, integral, one-piece structure. The portion 64 may be bolted directly to shell 2 or to the shell and bracket 8 as in the embodiment of FIG. 2.

The mode of attachment of the stabilizer elements of the shell 2 is not a limitation of the present invention. It is only necessary that they be rigidly and operatively attached to the drum shell either directly or by means of some other element. At their lower ends, the stabilizer elements are operatively attached to the shell 2 by means of the spur brackets 22 and 23. At their upper ends, as indicated above, the stabilizer elements can be affixed directly to the shell 2 or to the shell and tom-tom holder tube bracket 8. It would be within the scope of the present invention to provide a hole in the drum shell beneath bracket 8 to permit the stabilizer element to be directly attached to bracket 8.

What is claimed is:

1. A spur and stabilizer assembly for a bass drum having a cylindrical drum shell with its axis horizontally oriented, said assembly comprising a pair of hollow tubular stabilizer elements having upper and lower ends, said upper ends of said stabilizer elements being operatively affixed substantially adjacent each other to the upper portion of said shell, said tubular stabilizer elements extending downwardly and forwardly and diverging laterally with respect to and within said shell, a pair of spur brackets, each of said spur brackets being affixed to the outside surface of said shell and having a portion extending through a perforation in said shell, said lower end of each of said tubular stabilizing elements being open and being operatively connected to the adjacent one of said spur brackets, a pair of elongated, rod-like spurs, each of said spur brackets having a bore therethrough coaxial with the hollow interior of the connected one of said stabilizer elements, each spur being telescopically received in one of said spur bracket bores and the hollow interior of the connected one of said stabilizer elements, and a clamping means in association with each of said spur brackets to lock the respective one of said spurs therein in axially adjusted position.

2. The structure claimed in claim 1 wherein said connection between said lower end of each of said stabilizer elements and the adjacent one of said spur brackets is adjustable to accommodate for expansion and contraction of said drum shell.

3. The structure claimed in claim 1 including a tom-tom assembly bracket mounted on the upper outer surface of said shell by fastening means, each of said upper ends of said stabilizer elements being affixed to the inside upper surface of said shell by one of said bracket fastening means.

4. The structure claimed in claim 1 wherein said lower end of each of said stabilizer elements is slidably received in said bore of the adjacent one of said spur brackets, said spur thereof being telescopically received within said lower end of said stabilizer element, said lower end of said stabilizer element being bifurcated by a diametrically opposed, axially aligned pair of notches therein, said clamping means in association with each of said spur brackets comprising a manually operable set screw mounted therein, said set screw clamping said lower end of said stabilizer element within said spur bracket bore and clamping said spur within said lower end of said stabilizer element.

5. The structure claimed in claim 1 wherein said lower end of each of said stabilizer elements is bifurcated by a pair of diametrically opposed, axially aligned notches formed therein, said portion of each of said spur brackets extending through its respective perforation in said shell being tubular and of such outside diameter as to be slidably received within each said lower end of the adjacent one of said stabilizer elements, clamping means to clamp said lower end of said stabilizer element about said tubular portion of said spur bracket, the interior of said tubular portion of each of said spur brackets constituting a part of said spur bracket bore therein, said clamping means in association with each of said spur brackets comprising a manually actuable set screw abutting and clamping said spur in said spur bracket bore.

6. The structure claimed in claim 1 wherein said portion of each of said spur brackets extending through its respective perforation in said shell being tubular and of such outside diameter as to be slidably received within said lower end of the adjacent one of said stabilizer element, said tubular spur bracket portion being externally threaded, a nut mounted on said tubular spur bracket portion and abutting said lower end of said stabilizer element, the interior of said tubular portion of each of said spur brackets constituting a part of said spur bracket bore therein, said clamping means in association with each of said spur brackets comprising a manually actuable set screw abutting and clamping said spur within said spur bracket bore.

7. The structure claimed in claim 1 wherein said stabilizer elements are joined at their upper ends to comprise a single, integral, one-piece assembly.

* * * * *